US009828810B2

(12) United States Patent
Drews

(10) Patent No.: US 9,828,810 B2
(45) Date of Patent: Nov. 28, 2017

(54) MILL-DRILL CUTTER AND DRILL BIT

(71) Applicant: Varel International Ind., L.P., Carrollton, TX (US)

(72) Inventor: Steven W. Drews, Cypress, TX (US)

(73) Assignee: VAREL INTERNATIONAL IND., L.P., Carrollton, TX (US)

( * ) Notice: Subject to any disclaimer, the term of this patent is extended or adjusted under 35 U.S.C. 154(b) by 274 days.

(21) Appl. No.: 14/616,528

(22) Filed: Feb. 6, 2015

(65) Prior Publication Data

US 2015/0226010 A1 Aug. 13, 2015

Related U.S. Application Data

(60) Provisional application No. 61/937,335, filed on Feb. 7, 2014, provisional application No. 61/937,382, filed on Feb. 7, 2014.

(51) Int. Cl.
*E21B 10/55* (2006.01)
*E21B 10/573* (2006.01)
*E21B 29/00* (2006.01)

(52) U.S. Cl.
CPC ..... *E21B 10/55* (2013.01); *E21B 10/573* (2013.01); *E21B 29/00* (2013.01)

(58) Field of Classification Search
CPC ..... E21B 10/55; E21B 29/00; E21B 10/573
See application file for complete search history.

(56) References Cited

U.S. PATENT DOCUMENTS 4,382,477 A 5/1983 Barr
4,397,361 A 8/1983 Langford, Jr.
4,442,909 A 4/1984 Radtke
4,478,298 A 10/1984 Hake et al.
4,605,343 A 8/1986 Hibbs, Jr. et al.
4,823,892 A 4/1989 Fuller
4,889,017 A 12/1989 Fuller et al.
4,956,238 A 9/1990 Griffin
4,995,887 A 2/1991 Barr et al.
5,025,874 A 6/1991 Barr et al.
5,090,492 A 2/1992 Keith
5,127,923 A 7/1992 Bunting et al.
5,244,039 A 9/1993 Newton, Jr. et al.
5,346,025 A 9/1994 Keith et al.
5,437,343 A 8/1995 Cooley et al.
(Continued)

FOREIGN PATENT DOCUMENTS

EP 0676000 B1 6/2003
GB 12421 0/1914
(Continued)

OTHER PUBLICATIONS

"DrillShoe II, 4-Blade Models, Drilling with Casing", Weatherford International Ltd., 2005-2007 (4 pages).
(Continued)

*Primary Examiner* — Robert E Fuller
*Assistant Examiner* — Christopher J Sebesta

(57) ABSTRACT

A mill-drill cutter for an earth boring bit includes a cutting structure secured to a substrate. The cutting structure has a drilling edge, and the substrate has a milling edge. The substrate is configured to be received in a cutter pocket of the earth boring bit. The drilling edge of the cutting structure is disposed radially internal to the milling edge of the substrate.

22 Claims, 4 Drawing Sheets

(56) References Cited

U.S. PATENT DOCUMENTS

| | | | | |
|---|---|---|---|---|
| 5,460,233 | A | 10/1995 | Meany et al. | |
| 5,531,281 | A | 7/1996 | Murdock | |
| 5,549,171 | A | 8/1996 | Mensa-Wilmot et al. | |
| 5,551,522 | A | 9/1996 | Keith et al. | |
| 5,582,261 | A | 12/1996 | Keith et al. | |
| 5,651,421 | A | 7/1997 | Newton et al. | |
| 5,826,651 | A | 10/1998 | Lee et al. | |
| 5,887,668 | A | 3/1999 | Haugen et al. | |
| 5,979,571 | A | 11/1999 | Scott et al. | |
| 6,003,623 | A * | 12/1999 | Miess | E21B 10/55 175/426 |
| 6,062,326 | A | 5/2000 | Strong et al. | |
| 6,145,607 | A | 11/2000 | Griffin et al. | |
| 6,298,930 | B1 | 10/2001 | Sinor et al. | |
| 6,460,631 | B2 | 10/2002 | Dykstra et al. | |
| 6,510,906 | B1 | 1/2003 | Richert et al. | |
| 6,564,886 | B1 | 5/2003 | Mensa-Wilmot et al. | |
| 6,612,383 | B2 | 9/2003 | Desai et al. | |
| 6,672,406 | B2 * | 1/2004 | Beuershausen | E21B 10/43 175/430 |
| 6,904,984 | B1 * | 6/2005 | Estes | E21B 10/5735 175/430 |
| 7,140,448 | B2 * | 11/2006 | Estes | E21B 10/5735 175/430 |
| 7,159,487 | B2 | 1/2007 | Mensa-Wilmot et al. | |
| 7,178,609 | B2 | 2/2007 | Hart et al. | |
| 7,395,882 | B2 | 7/2008 | Oldham et al. | |
| 7,398,840 | B2 | 7/2008 | Ladi et al. | |
| 7,426,969 | B2 | 9/2008 | Azar | |
| 7,757,793 | B2 | 7/2010 | Voronin et al. | |
| 7,836,978 | B2 | 11/2010 | Scott | |
| 7,998,573 | B2 | 8/2011 | Qian et al. | |
| 8,025,112 | B2 | 9/2011 | Mirchandani et al. | |
| 8,210,288 | B2 * | 7/2012 | Chen | E21B 10/55 175/420.1 |
| 8,225,886 | B2 | 7/2012 | Mirchandani et al. | |
| 8,459,380 | B2 | 6/2013 | Mirchandani et al. | |
| 8,517,123 | B2 | 8/2013 | Reese | |
| 8,978,788 | B2 * | 3/2015 | Vempati | C22C 26/00 175/426 |
| 9,033,070 | B2 * | 5/2015 | Shen | E21B 10/5673 175/430 |
| 9,316,057 | B2 * | 4/2016 | Chen | E21B 10/55 |
| 9,388,639 | B2 * | 7/2016 | Patel | E21B 10/42 |
| 2002/0170713 | A1 | 11/2002 | Haugen et al. | |
| 2004/0226751 | A1 | 11/2004 | McKay et al. | |
| 2004/0228694 | A1 | 11/2004 | Webb et al. | |
| 2004/0244540 | A1 | 12/2004 | Oldham et al. | |
| 2005/0103530 | A1 | 5/2005 | Wheeler et al. | |
| 2005/0183892 | A1 | 8/2005 | Oldham et al. | |
| 2006/0048973 | A1 | 3/2006 | Brackin et al. | |
| 2006/0070771 | A1 | 4/2006 | McClain et al. | |
| 2007/0079995 | A1 | 4/2007 | McClain et al. | |
| 2007/0131459 | A1 | 6/2007 | Voronin et al. | |
| 2007/0144789 | A1 | 6/2007 | Johnson et al. | |
| 2007/0175672 | A1 | 8/2007 | Eyre et al. | |
| 2007/0193782 | A1 | 8/2007 | Fang et al. | |
| 2007/0261890 | A1 | 11/2007 | Cisneros | |
| 2007/0278017 | A1 | 12/2007 | Shen et al. | |
| 2008/0093124 | A1 | 4/2008 | Giroux et al. | |
| 2008/0149398 | A1 | 6/2008 | Azar | |
| 2008/0223575 | A1 | 9/2008 | Oldham et al. | |
| 2009/0120693 | A1 | 5/2009 | McClain et al. | |
| 2010/0051349 | A1 | 3/2010 | Ballard et al. | |
| 2010/0084198 | A1 * | 4/2010 | Durairajan | E21B 10/55 175/430 |
| 2010/0089661 | A1 | 4/2010 | Welch et al. | |
| 2010/0282519 | A1 | 11/2010 | Zhang et al. | |
| 2010/0307837 | A1 | 12/2010 | King et al. | |
| 2011/0061943 | A1 * | 3/2011 | Richert | E21B 10/43 175/428 |
| 2011/0100721 | A1 | 5/2011 | Aliko et al. | |
| 2011/0259604 | A1 | 10/2011 | Oldham et al. | |
| 2011/0259605 | A1 | 10/2011 | Oldham et al. | |
| 2011/0259606 | A1 | 10/2011 | Oldham et al. | |
| 2011/0259608 | A1 | 10/2011 | Oldham et al. | |
| 2011/0259643 | A1 | 10/2011 | Oldham et al. | |
| 2011/0266069 | A1 | 11/2011 | Oldham et al. | |

FOREIGN PATENT DOCUMENTS

| | | | |
|---|---|---|---|
| GB | 1153988 | A | 6/1969 |
| GB | 2339227 | B | 11/2002 |
| GB | 2429731 | B | 8/2008 |

OTHER PUBLICATIONS

"DrillShoe II, 5-Blade Models, Drilling with Casing", Weatherford International Ltd., 2008 (4 pages).

"DrillShoe III, Drilling with Casing", Weatherford International Ltd., 2005-2008 (4 pages).

Galloway G.: "Rotary Drilling with Casing—A field proven method of reducing wellbore construction cost," World Oil Casing Drilling Technical Conference, Mar. 6-7, 2003 (7 pages).

Hughes Christensen, "Reduce Risk, Ensure your casing gets to total depth", EZReam, Baker Hughes Inc, 2007 (4 pages).

McKay, D., et al.: "New Developments in the Technology of Drilling with Casing: Utilizing a Displaceable DrillShoe Tool," World Oil Casing Drilling Technical Conference, Mar. 6-7, 2003 (11 pages).

PCT Search Report and Written Opinion for PCT/US2015/014908 dated May 29, 2015 (17 pages).

Sinor, Allen: "Casing Drilling—Recent Advances for Drilling Challenges," Hughes Christensen—A Baker Hughes Company, The Woodlands, TX, SPE Gulf Coast Section Jan. 10, 2001 (34 pages).

Sinor, L.A., et al.: "Rotary Liner Drilling for Depleted Reservoirs," IADC/SPE 39399, Mar. 3-6, 1998 (10 pages).

Tarr, Brian, et al.: "Casing-while-Drilling: The Next Step Change in Well Construction," Published in World Oil, Oct. 1999 issue (10 pages).

* cited by examiner

MILL-DRILL CUTTER AND DRILL BIT

PRIORITY CLAIM

This application claims priority to U.S. Provisional Application for Patent Ser. No. 61/937,335, filed on Feb. 7, 2014, and entitled "Mill-Drill Cutter and Drill Bit," and to U.S. Provisional Application for Patent Ser. No. 61/937,382, filed on Feb. 7, 2014, and entitled "Pocket for Mill-Drill Cutter and Drill Bit," the disclosures of which are hereby incorporated by reference.

TECHNICAL FIELD

The present invention relates generally to bits for drilling a wellbore, and more particularly to a dual-purpose cutter and drill bit for milling through a steel well casing and continued drilling through a subterranean rock formation.

BACKGROUND

The diamond layers of PDC drill bit cutters are extremely wear and abrasion resistant but can readily suffer chipping when exposed to impact or high point loading during shipping, handling, and running into the wellbore. The cutters are also susceptible to diamond graphitization at the cutting tip due to a chemical reaction with ferrous materials at high frictional temperatures produced during cutting when ferrous materials are encountered, such as in the drilling out of casing windows or the drilling out of casing-associated equipment. Other materials, such as tungsten carbide, or cubic boron nitride (CBN), are better at cutting ferrous materials but are not as effective at cutting rock that is encountered for instance after casing or casing-associated components have been drilled through. For the purposes of this disclosure, "casing-associated component" is meant to include, but is not limited to, the following: stage cementing equipment, float shoes, shoe tracks, float collars, float valves, wipers, activation darts, activation balls, inflatable packers, mechanical packers, swellable packers, circulation subs, casing shoes, casing bits, reamer shoes, guide reamers, liner guides, liner bits, motor driven shoes, motor driven reamers, motor driven bits, disposable or one-trip motors, and disposable or one-trip turbines. In other words, a "casing-associated component" is defined as any deployed or installed obstruction within a wellbore casing, or mounted within, at, or outside the end of the casing, that may be encountered in whole or in part by a drill bit.

Historically, ferrous materials associated with casing-associated components were drilled out with a specialty bit or milling tool before the preferred bit for the formation application was tripped into the hole. The potential cost savings in trip time of having a bit that could effectively drill through the casing or casing-associated equipment drove the development of new combination bits oftentimes referred to as mill drills. Bits in this area of art are typically called upon to drill between 1 and 35 linear feet of casing or casing-associated components. In the instance of casing window milling the tools must remove a few lateral inches of casing wall thickness while drilling down several linear feet. In casing exit milling, the distance to be drilled through the casing wall is dependent on the configuration and slope angle of the whipstock that is used to push the bit into the casing wall. In both cases, the relatively short amount of drilling of the casing or casing-associated equipment occurs prior to drilling through hundreds or even several thousands of feet of formation.

Prior art efforts to provide solutions for cutter protection and/or casing and casing-associated component milling and subsequent formation drilling are set forth below. All references discussed herein are incorporated by reference.

U.S. Pat. No. 8,517,123 to Reese describes a cap structure for the PDC cutter that includes a first portion overlying, but not attached to, a front face of the diamond table layer and a second portion extending perpendicularly from the first portion which is overlying and attached to an outer peripheral surface of the underlying substrate layer.

U.S. Pat. No. 4,397,361 to Langford describes abradable cutter protection afforded by individual protrusions projecting from the head portion of the bit more than the extension of the PDC cutting elements. These protrusions are fabricated of a metal more readily abraded by the earth formation than any of the cutting elements.

U.S. Pat. Nos. 4,995,887 and 5,025,874 to Barr et al describe PDC cutters, which have an additional layer of tungsten carbide bonded to the face of the diamond layer. This bonding is achieved in a high temperature, high pressure press. What is described are "cutting elements in which a further front layer of less hard material, usually again tungsten carbide, is bonded to the front face of the diamond layer and extends across at least the major part thereof. Since the less hard material of the further layer may have better toughness in tension than the diamond layer, this may enable the cutting element better to resist tensile stress . . . ."

U.S. Pat. No. 5,979,571 to Scott et al describes a "Combination Milling Tool and Drill Bit". In the Scott approach, tungsten carbide inserts are mounted in an outward row on a blade that extends from the main body of the drill bit. The outward mounted tungsten carbide inserts attached to the outward projecting portion of a blade are meant to protect an underlying row of PDC inserts connected to the same blade. Alternatively, a more outwardly projecting blade carrying tungsten carbide inserts acts to protect a less outwardly projecting blade carrying PDC inserts. In either case, the parent blade material of the combined blade or of the separate blades will create a bearing area after the tungsten carbide cutters have worn away. In another embodiment, a tungsten carbide layer is pressed in a high pressure/high temperature press onto the face of the PDC cutters. In another embodiment PDC cutters are embedded in the center of a ring of protective tungsten carbide insert material. In the case where the cutters are embedded in a ring of tungsten carbide the face of the PDC portion of the cutters is fully exposed and unprotected from metal debris encountered during drill out. In addition, as the combined element enters formation and the tungsten carbide ring begins to wear, bearing areas of tungsten carbide co-exist with and are adjacent to the PDC diamond layer throughout the life of the bit. In addition, the surrounding rings of tungsten carbide either reduce the total number of cutters that can be placed on a blade or overall bit face, or they reduce the diameter of the PDC diamond layers available for formation cutting. Either of these choices represents compromising departures from standard PDC bit designs.

U.S. Pat. No. 5,887,668 to Haugen et al describes milling bits with a sacrificial nose cone beneath the bit, a cutting structure intended to mill a window, and in some embodiments a cutting structure intended to drill ahead in formation. The bits described by Haugen are purpose built for these operations.

U.S. Pat. No. 6,612,383 to Desai et al describes a dual function drag bit using PDC cutters faced with a bonded tungsten carbide layer. These cutters are described as being made in a high temperature/high pressure press.

U.S. Pat. No. 7,178,609 to Hart et al describes a Window Mill and Drill Bit that uses separate blades or cutter sets of primary cutting structure for milling and secondary blades or cutter sets for formation drilling. In addition, Hart describes an attachment method whereby the mill is attached to a whipstock boss using a shear bolt that directly attaches to a threaded socket deployed in a purpose built relief area on the working face of the mill.

U.S. Patent Application Publication No. 2006/0070771 to McClain et al describes Earth Boring Drill Bits with Casing Component Drill Out Capability and Methods of Use. Cutting elements aimed at cutting through wellbore equipment are deployed in separate, more highly exposed sets than cutters aimed at drilling the formation.

U.S. Patent Application Publication No. 2007/0079995 to McClain et al describes Cutting Elements Configured for Casing Component Drillout and Earth Boring Drill Bits Including Same. FIGS. 7A and 7B of the '995 application show a bonded cutter where the leading superabrasive element is bonded to a backing abrasive element that protrudes beyond the top of the circular, leading superabrasive element.

U.S. Pat. No. 7,836,978 to Scott points out that "One drawback associated with providing two sets of cutting elements on a drill bit . . . is an inability to provide an optimum cutting element layout for drilling the formation after penetration of casing or casing components and surrounding cement. This issue manifests itself not only in problems with attaining an optimum cutting action, but also in problems, due to the presence of the required two sets of cutting elements, with implementing a bit hydraulics scheme effective to clear formation cuttings using a drilling fluid when any substantial rate of penetration (ROP) is sought." Scott's solution to the drawback is to provide the drill bit with cutters configured (via coating, deposition, or HPHT bonding) with a non-reactive superabrasive material, such as cubic boron nitride, overlaying or deployed with traditional diamond cutting material, such as PDC.

Various pocket configurations have been employed to ensure a close fit braze joint for joining conventional PDC cutters to the pocket. For example, U.S. Pat. No. 7,159,487 to Mensa-Wilmot, which is hereby incorporated by reference, discloses a partial relief that is cast into the lower lip area of a cutter pocket to provide a relief for the diamond table adjacent to the pocket. U.S. Pat. No. 4,442,909 to Radtke, which is hereby incorporated by reference, discloses a relief that has been provided to the lower part of the PDC cutter of the press fit stud mount type by machining a scallop offset in the drilling direction of cut from the parent press fit hole.

It has been demonstrated that all drill out applications including float equipment, shoe tracks, casing shoes, casing reamers, casing bits, stage cementing equipment, frac plugs, one-trip or disposable motors or turbines, or exit windows may have damaging effects on standard PDC bits. This continues to be the case even when great efforts are made in design and material substitutions to make the equipment more drill out friendly.

SUMMARY

A mill-drill cutter for an earth boring bit includes a cutting structure secured to a substrate. The cutting structure has a drilling edge, and the substrate has a milling edge. The substrate is configured to be received in a cutter pocket of the earth boring bit. The drilling edge of the cutting structure is disposed radially internal to the milling edge of the substrate.

According to one embodiment, the cutting structure is a polycrystalline diamond compact (PDC) cutting structure and the substrate comprises tungsten carbide. In an alternate embodiment the cutting structure comprises cubic boron nitride.

According to one embodiment, the substrate of the mill-drill cutter has a rounded rear surface that is received by the cutter pocket. An alternate embodiment includes a flat, circular rear surface that is received by the cutter pocket.

An earth boring bit includes a plurality of blades where each blade includes a plurality of cutter pockets within which a mill-drill cutter is secured.

Technical advantages of embodiments of the present disclosure include a single cutter within a single cutter pocket, which is operable to engage with two separate cutting structures. An outer cutting structure is configured to mill metal of a casing material, and an inner cutting structure is configured to drill a subterranean formation. The outer cutting structure protects the inner cutting structure until it wears away and thereby exposes the inner cutting structure.

Another technical advantage of the present disclosure includes a mill-drill cutter that is axisymmetric such that it can be removed from the cutter pocket, rotated about its longitudinal axis and re-secured within the cutter pocket. In this manner, fresh milling and drilling cutting structures and edges replace worn milling and drilling cutting structures and edges by simply rotating the mill-drill cutter.

BRIEF DESCRIPTION OF THE DRAWINGS

For a more complete understanding of the present invention and the advantages thereof, reference is now made to the following brief description, taken in connection with the accompanying drawings and detailed description, wherein like reference numerals represent like parts, in which.

DETAILED DESCRIPTION

A cutter for a drill bit according to the present disclosure includes a cutting element with combined polycrystalline diamond compact ("PDC") and tungsten carbide cutting structures in a single cutter to perform dual-purpose drilling. The cutter effectively mills out a steel well casing and once through the casing, the cutter is configured to continue drilling into the rock formation. The mill-drill bit of the present disclosure includes a plurality of blades where each blade supports a plurality of dual-purpose or mill-drill cutters.

The dual-purpose cutter includes two separate cutting edges to perform two different tasks. The dual-edge cutter is manufactured in two parts, a tungsten carbide substrate and a PDC diamond layer that is LS (long substrate) bonded to the tungsten carbide substrate. The tungsten carbide substrate is manufactured to a larger diameter than the PDC layer. It is on this tungsten carbide substrate that a prepared cutting edge is machined or otherwise formed to mill a steel casing or other hard material. And, since the diameter of the cutting edge on the carbide substrate is larger the PDC layer, the tungsten carbide cutting structure protects the PDC layer from damage that would otherwise result from contact between the PDC layer and the steel of the casing-associated component.

Figure 1:
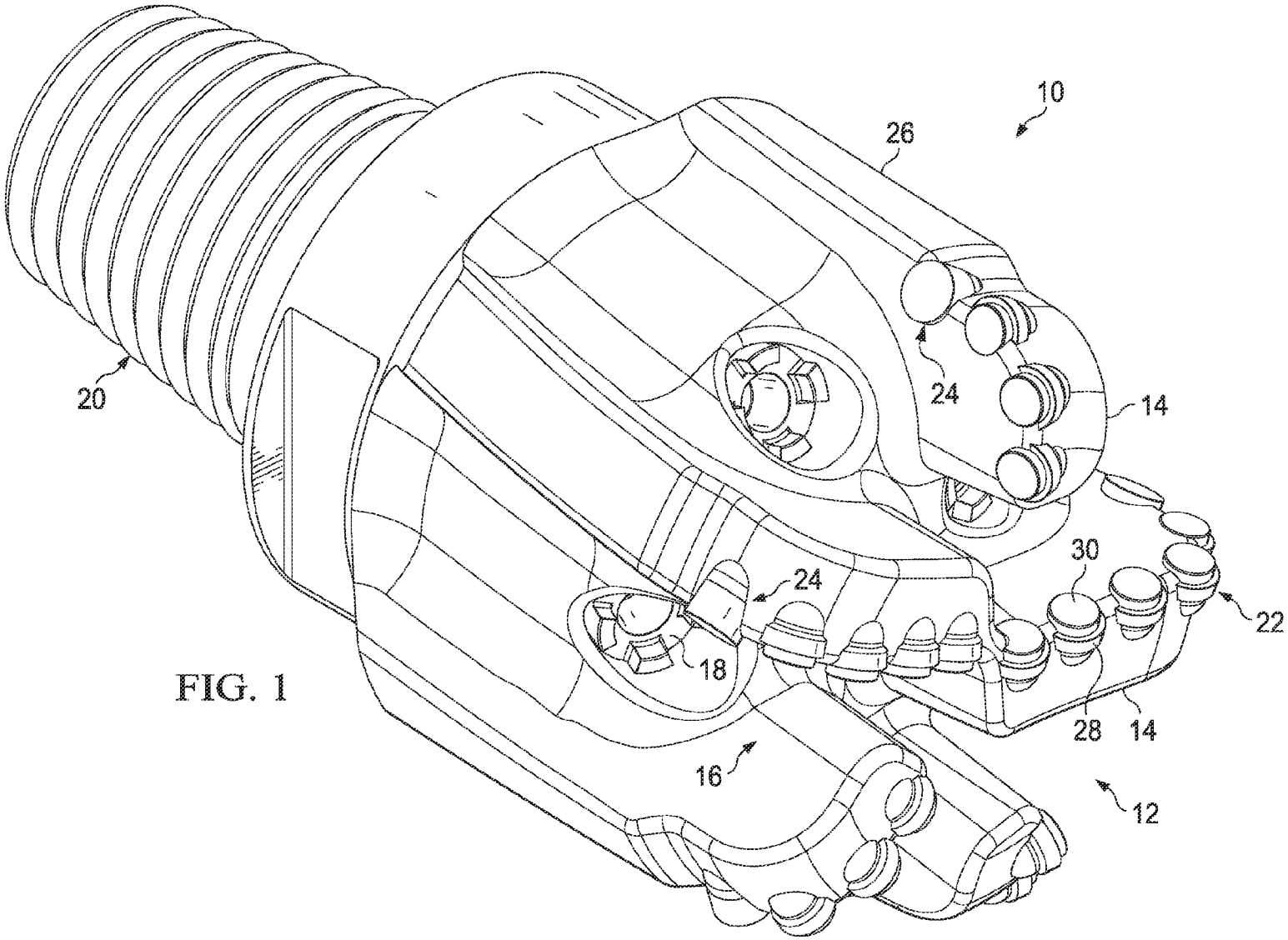
FIG. 1 illustrates a perspective view of a mill-drill bit according to the teachings of the present disclosure.

Reference is made to FIG. 1, which illustrates a mill-drill bit 10 according to the teachings of the present disclosure. The mill-drill bit 10 is a fixed cutter bit. It includes a bit face 12 defining a plurality of radially extending blades 14. The blades 14 may be straight or spiral blades or any other configuration known in the art to support fixed cutters. The blades 14 are separated from each other by junk slots 16. A drilling fluid nozzle 18 is also disposed between the blades 14. Threads 20 formed in an attaching portion of the bit 10 allows the bit 10 to be attached to a drill string and rotated such that the cutters perform either milling a casing-associated component or drilling through a rock formation to form a borehole. The bit 10 may be cast from a matrix material, or it may be machined from steel. In certain embodiments, the bit 10 is formed by a casting process, and then additional details are machined in the bit 10. For example, the blades 14 may be primarily formed by casting, and then the threads 20 may be machined.

Each of the blades 14 supports a plurality of cutters. The cutters are secured into pockets that are formed in the blades 14. The bit 10 employs a variety of cutters. For example, the bit employs mill-drill cutters 22 according to the teachings of the present disclosure that are disposed radially inward of a gage 26 to cut an inner portion of a casing or a borehole. Each blade 14 of the bit 10 also employs conventional PDC cutters 24 that are disposed proximate the gage 26 of the bit 10. In certain embodiments, all of the cutters of a particular blade 14 or all of the cutters of the mill-drill bit 10 may be mill-drill cutters 22 and be configured to cut a steel casing with one portion of the cutter and configured to cut an earth formation with a different portion of the same cutter 22. As described further below, the mill-drill cutter 22 includes an enlarged diameter milling portion 28 and a PDC diamond table surface 30. In milling a steel casing and through contact with a rock formation, a portion of the milling surface will wear away and expose the PDC diamond table drilling surface 30 to cut the earth formation.

Figure 2A:
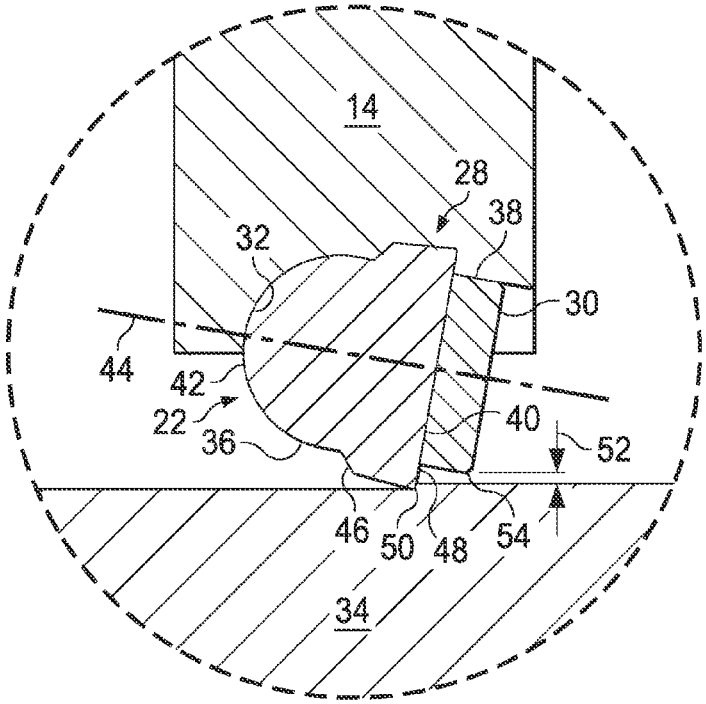
FIGS. 2A and 2B are cross-sections of a mill-drill cutter in a milling and a drilling operation, respectively.

Reference is made to FIG. 2A, which is a cross-section of the mill-drill cutter 22 in a pocket 32 formed in a blade 14. The mill-drill cutter 22 is illustrated as cutting a metal casing 34. According to certain embodiments, the mill-drill cutter 22 is secured within the cutter pocket 32 by brazing, although other methods may be used. The braze material used to secure the mill-drill cutter 22 within the pocket 32 typically has a melting point in a range of 1300 degrees Fahrenheit to 1330 degrees Fahrenheit.

The mill-drill cutter 22 includes a substrate 36 and a PDC cutting structure 38 secured to the substrate 38. The substrate 36 is delimited on one end by a flat, circular face 40 and on an opposite end by a rounded rear surface 42. The substrate 36 is formed from tungsten carbide or any other suitable material. In certain embodiments, the tungsten carbide may have a percentage of cobalt to facilitate machining the features describe herein. For example, the substrate 36 can be made of "low cobalt" type machining grade with cobalt in the 3% to 10% range, where conventional PDC cutters typically use tungsten carbide in the 11% to 14% cobalt range.

A front portion of the substrate 36 includes the enlarged diameter portion 28, which is a generally cylindrical portion of the substrate 36. The enlarged diameter portion 28 extends radially outward with respect to a longitudinal axis 44 of the cutter 22, beyond the PDC cutting structure 38. A rear portion of the generally cylindrical enlarged diameter portion 28 includes a beveled surface 46. The enlarged diameter portion 28 is delimited on one end by the flat, circular face 40 and on the other end by the beveled surface 46. An exposed portion of an annular portion of the face 40 extending outward beyond the PDC cutting structure 38 is the milling surface 48. A perimeter of the milling surface 48 is a milling edge 50. A drilling edge 54 of the PDC cutting structure 38 is disposed radially internal to the milling edge 50. The diameter of the enlarged diameter portion 28 may be 10%-50% larger than the diameter of the PDC cutting structure 38. According to one embodiment, a diameter of the face 40 of the enlarged diameter portion 28 is approximately 14.17 millimeters. A diameter of a face of the PDC diamond table surface 30 is approximately 11 millimeters.

The PDC cutting structure 38 is secured to the face 40 to be coaxial with the substrate 36. The PDC cutting structure 38 includes the diamond table layer 30, which functions as the primary drilling surface for drilling the rock formation. The diamond table layer 30 may be non-leached, shallow leached, deep leached, or resubstrated fully leached, as desired. In other embodiments, the diamond table layer 30 may be replaced with cubic boron nitride, or other hard material.

The enlarged diameter portion 28 performs multiple functions. For example, the enlarged diameter portion 28 provides the face surface 40 on which a PDC cutting structure 38 is secured. The PDC structure 38 may be brazed to the face 40 of the substrate or otherwise secured using joining methods that are known in the art of earth boring drill bits. For example, the PDC cutting structure 38 may be secured to the substrate 36 using a high temperature/high strength braze joint or LS (long substrate bond) as is known in the art. The braze joint may be created using an induction brazing process performed in a controlled atmosphere to produce a high quality, high strength braze joint or bond.

As described above, the portion of the enlarged diameter portion 28 that extends radially beyond the PDC cutting structure 28 provides the milling surface 48. A milling edge 50 is prepared at a perimeter of the milling surface 48. As shown in FIG. 2A, the milling surface 48 engages the metal casing 34 and tears, cuts, shears, and rips apart the metal casing 34.

Because it extends beyond the PDC cutting structure 38, the enlarged diameter portion 28 protects the PDC cutting structure 38 from contact with the metal casing 34. As shown in FIG. 2A, there is a clearance distance 52 between the casing-associated component 34 and the PDC cutting structure 38. The clearance distance 52 is provided by the engagement of the milling edge 50 and/or the milling surface 48 with the casing 34. The clearance distance 52 decreases as the enlarged diameter portion 28 wears away due to abrasion and wear caused by milling the casing 34 and abrasion resulting from contact with the subterranean rock formation encountered after milling through the casing-associated component 34. Ultimately, the clearance distance 52 reduces to zero and the PDC cutting structure 38 will be engaged and perform the cutting function. Preferably, the milling action wears away the enlarged diameter portion 28 and reduces the clearance distance to zero once the milling is complete or shortly thereafter. In this manner, a fresh drilling surface and drilling edge 54 of the PDC diamond table 30 that has not been degraded due to contact with the casing 34 is exposed to drill the rock formation.

Figure 2B:
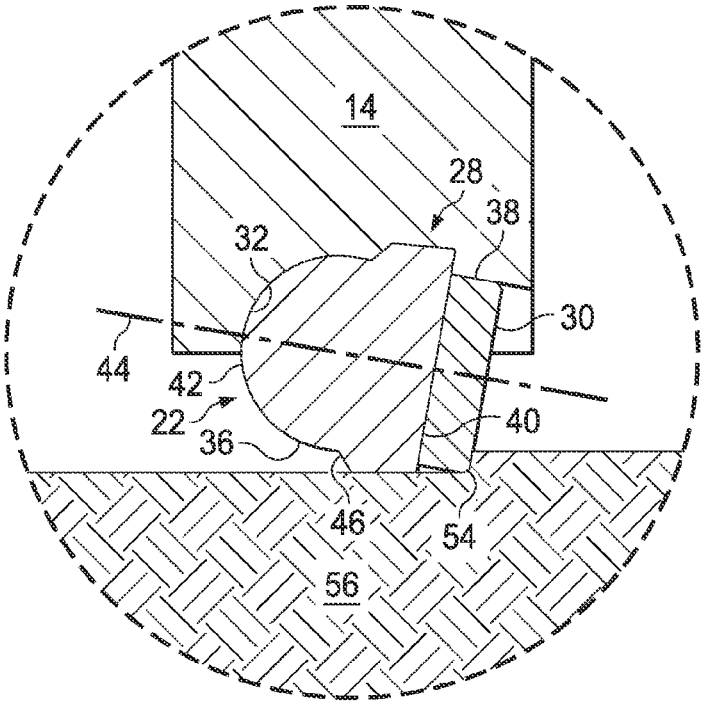

Reference is made to FIG. 2B, which illustrates the mill-drill cutter 22 of FIG. 2A performing a drilling operation. Once the milling operation is completed, and the mill-drill bit 10 begins formation drilling, the enlarged diameter portion 38 of the substrate 36 wears or breaks away so as to allow the diamond table 30 to function as the primary cutting structure to drill a subterranean rock formation 56. In this way, the drill bit 10 can be first used for milling (with the milling surface 48 and milling edge 50) and then used for drilling (with the diamond table 30 and the drilling edge 54 of the PDC cutting structure 38), thus obviating the need to use and then pull a specialized milling bit from the hole.

FIG. 2B does not show a clearance distance, as shown in FIG. 2A (reference number 52) because it has been reduced to zero by the wearing away of the milling portion of the enlarged diameter portion 38 of the substrate 36 that includes the milling surface 48. In the earth drilling (rock formation drilling) operation, the drilling surface of the PDC diamond table layer 30 and the drilling edge 54 engage the formation 56 to rip, cut, and break apart the formation. The original milling edge 50 and has worn away at least in part due to abrasion and other wear mechanisms resulting from milling through the casing 34. Because it has worn away, the enlarged diameter portion 28 no longer creates a clearance distance between the drilling edge 54 and the formation 56.

The mill-drill cutter 22 is axisymmetric about its longitudinal axis 44. As such, the mill-drill cutter 22 can be removed from the pocket 32, rotated, and re-secured within the pocket 32. Methods, typically involving heating to break down the brazing material, and separate cutters from cutter pockets are known in the art. The pocket 32 may be cleaned or otherwise prepared to receive a rotated mill-drill cutter 22. Then, the mill-drill cutter 22 may be rotated approximately 180 degrees about its longitudinal axis 44 and re-brazed into the pocket 32. Thus, the portion of the enlarged diameter portion 28 that was secured in a groove formed in the pocket 32 is now in a milling position and is configured to cut and break apart casing. Similarly, the portion of the PDC cutting structure 38 that was furthest from and had the least exposure to the materials being milled or drilled is now in a position to have the greatest exposure to the materials being milled or drilled.

Figure 3:
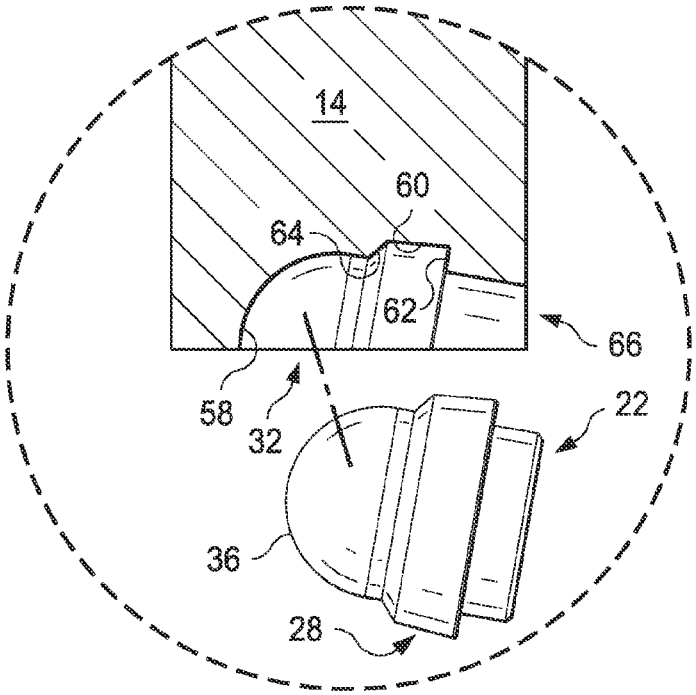
FIG. 3 illustrates a mill-drill cutter exploded from a cutter pocket.

Reference is made to FIG. 3, which is a cross section of the blade 14 and the pocket 32 with the mill-drill cutter 22 exploded from the pocket 32. The contours of the pocket 32 correspond to the shape of the mill drill cutter 22. For example, the pocket 32 includes a rounded rear surface 58 that corresponds to the rounded rear surface 42 of the substrate 36 of the mill-drill cutter 22. Similarly, the pocket includes a recess or groove 60 that corresponds to the enlarged diameter portion 28 of the substrate 36. The recess 60 is configured to accommodate the enlarged diameter of the outer cutting structure of the increased diameter portion 28. The recess may have a flat faced surface 62 in the drilling direction of cut and beveled surface 64 at the opposite trailing side. According to an embodiment, a depth of the groove corresponds to the portion of the enlarged diameter portion 28 that extends beyond the PDC cutting structure 38.

The pocket 32 may be partially or completely formed using a graphite displacement disposed in the location of the pocket 32 during casting of the body of the mill-drill bit 10. Subsequent machining operations may be performed on the cast pocket. The cutter pocket 32 including the groove 60 provides an increased surface area for retention of the mill-drill cutter 22.

The bit may be formed from steel, a matrix material, or other materials known in the art. A steel mill-drill bit may be machined to form the pocket 32 including the rounded rear surface 58 and the recess 60 corresponding to the increased diameter portion 28 of the mill-drill cutter 10.

Figure 4:
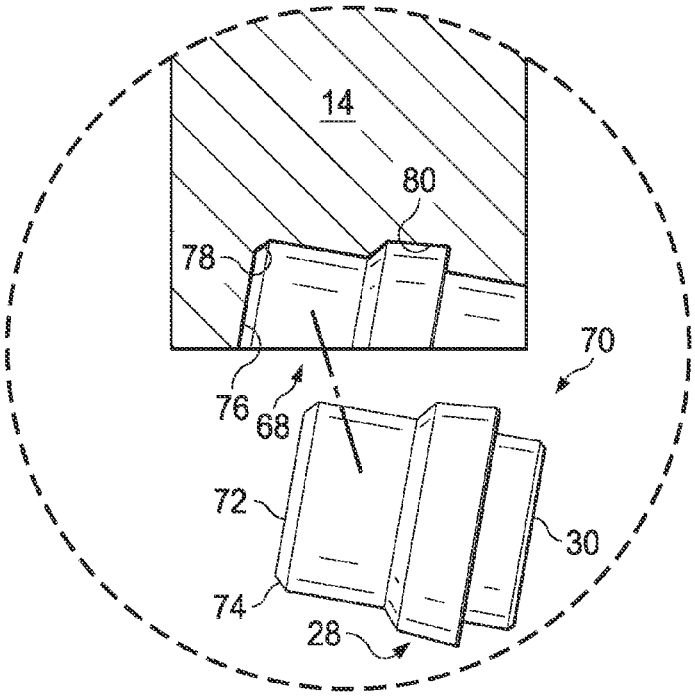
FIG. 4 illustrates an alternate embodiment of a mill-drill cutter exploded from a cutter pocket.

Reference is now made to FIG. 4, which illustrates an alternate embodiment of a cutter pocket 68 and a mill-drill cutter 70. FIG. 4 is a cross section of a blade 14 with the cutter pocket 68 and a flat back mill-drill cutter 70 exploded from the pocket 68. The mill-drill cutter 70 includes a generally flat, circular rear surface 72 of the substrate. A perimeter 74 of the flat rear surface 72 is beveled. Similarly, the pocket 68 formed in the blade 14 includes a generally flat rear surface 76 with a beveled perimeter 78 corresponding to the flat rear surface 72 and beveled perimeter 74 of the substrate of the flat back mill drill cutter 70. Similar to the rounded rear surface pocket 32 embodiment shown in FIG. 3, the pocket 68 includes a recess or groove 80 shaped to receive the enlarged diameter portion of the substrate. The mill-drill cutter 70 is brazed to secure it in the pocket 68 as described above with respect to FIG. 3.

Figure 5A:
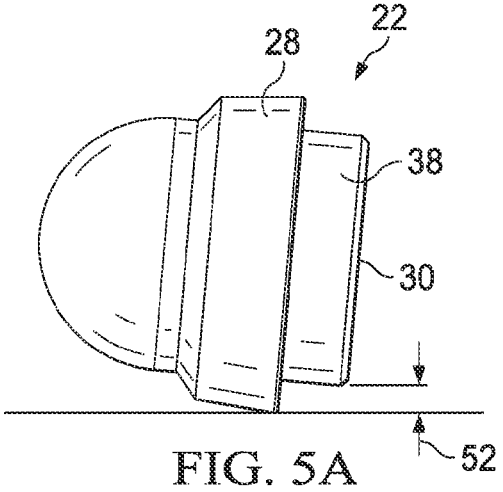
FIGS. 5A-5D illustrate different rake angles that may be employed with the mill-drill cutter according to the teachings of the present disclosure.
Figure 5B:
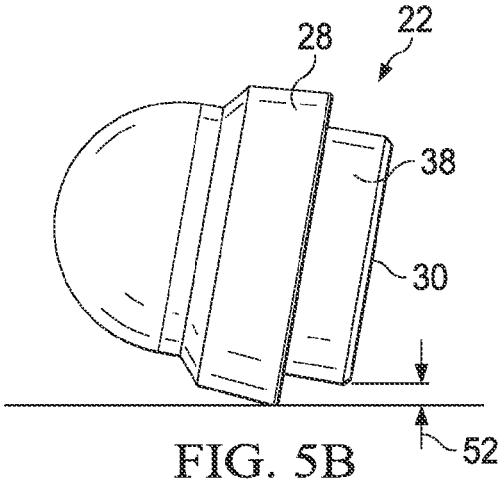
Figure 5C:
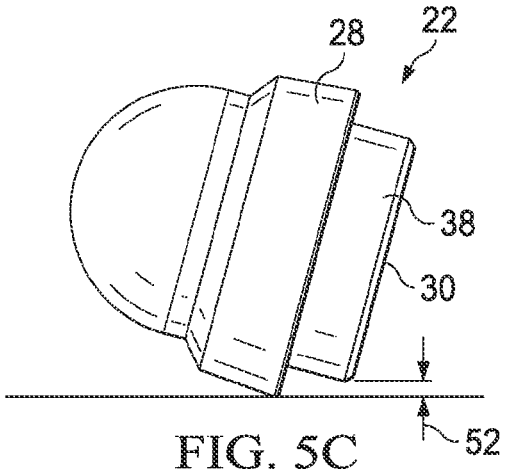
Figure 5D:
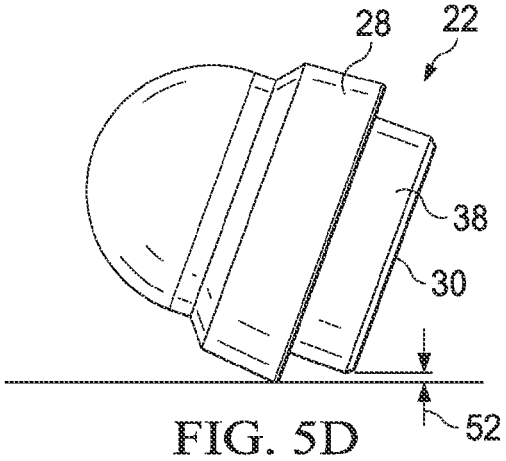

Reference is now made to FIGS. 5A-5D, which illustrate the mill-drill cutter 22 at different rake angles. The pocket 32 (or pocket 68) is formed to accommodate the desired rake angle of the mill-drill cutter 22 (or mill-drill cutter 70). FIG. 5A shows a rake angle of 5 degrees. Also, the less the rake angle the greater the clearance distance 52, which means more of the enlarged diameter portion 28 of the substrate 36 is exposed to the material. As such, the mill-drill cutters 22 at shallower rake angles can be used for increased milling before wearing to a clearance distance 52 of zero and exposure of the PDC cutting structure 38 and the drilling surface 30. FIG. 5B illustrates a rake angle of 10 degrees. FIG. 5C illustrates a rake angle of 15 degrees, and FIG. 5D illustrates a rake angle of 20 degrees. Any suitable rake angle may be employed according to the teachings of the present disclosure.

A mill-drill bit 10 that employs mill-drill cutters 22, 70 according to the teachings of the present disclosure can mill through casing, or drill out through a casing bit or frac plug and then drill ahead into formation. Mill-drill cutters and bits including dual purpose (i.e. mill/drill) cutters may be used in connection with casing window mills, mill-drills, and PDC casing bit drill out bits. In addition, reamers may include mill-drill cutters and be used in conjunction with window milling.

The mill-drill cutters 22 are robust enough to accomplish the milling tasks asked of them while being structurally predisposed to disintegration and shedding when milling is completed and the bit moves forward for drilling the formation. Mill-drill bits according to the teachings of the present disclosure can be used to drill out steel bodied casing shoe bits or casing shoe bits constructed from other materials extending the casing shoe bit choices of casing drilling operations. Bits of the current disclosure can also be used in one trip mill drill systems where the bit is attached at the top of a whipstock for running in the hole.

The mill-drill bit as described herein can be advantageously used in combined milling and formation drilling operations. In accordance therewith, a mill-drill bit 10 with certain ones of the cutters being mill-drill cutters is provided for attachment to a drill string or other drilling equipment. The milling surface 48 is configured for milling operations on a casing-associated component located in the hole but is not optimal for earth formation drilling operations. The drill bit is rotated and the milling surface 48 of the mill-drill cutters 22 perform a down hole milling operation on the casing-associated component. Drilling with the mill-drill bit 10 continues after milling of the casing-associated component to drill an underlying earth formation. Importantly, the same drill bit is being used, and thus there is no need to pull a milling bit from the hole before resuming formation drilling. The drilling of the earth formation causes a portion of the milling surfaces of the mill-drill cutters to be destroyed and thus expose the drilling surface of the diamond table to engage the subterranean earth formation.

It will be understood that the mill-drill bit described herein is equally applicable to any downhole tool that might otherwise use conventional PDC cutters. For example, the mill-drill cutters could be used in connection with downhole tools comprising: bi-center bits, casing shoe bits, PDC reamers, PDC hole openers, expandable reamers, PDC set stabilizers, PDC set guide shoes and reaming guide shoes. More generally, the mill-drill cutters are applicable to downhole tools expected to engage or come in contact with any "casing" or "casing-associated component" as previously described.

The foregoing describes only some embodiments of the invention(s), and alterations, modifications, additions and/or changes can be made thereto without departing from the scope and spirit of the disclosed embodiments, the embodiments being illustrative and not restrictive.

What is claimed is:

1. A cutter for an earth boring bit, comprising:

a cutting structure having a drilling edge and made from a superabrasive material; and a substrate secured to the cutting structure, made from a softer material than the superabrasive material, and having a milling edge, the softer material of the substrate configured to be received by a cutter pocket of the earth boring bit, the drilling edge of the cutting structure disposed radially internal to the milling edge of the substrate, wherein:

the substrate is delimited on an end adjacent to the milling edge by a flat face, the cutting structure is secured to the flat face, a portion of the flat face extending outward of the cutting structure is an exposed milling surface, the milling edge and surface are operable to engage with a casing or associated component thereof, and the milling edge is operable to create a clearance distance between the casing or associated component thereof and the cutting structure while the milling edge and surface mill therethrough, and the milling edge, the flat face, and the milling surface are also made from the softer material.

2. The cutter of claim 1 wherein softer material is tungsten carbide.

3. The cutter of claim 2 wherein the superabrasive material is polycrystalline diamond compact and the cutting structure comprises a diamond table layer.

4. The cutter of claim 3 wherein the drilling edge is disposed at a perimeter of the diamond table layer.

5. The cutter of claim 2 wherein the superabrasive material is cubic boron nitride.

6. The bit of claim 2, wherein the tungsten carbide is low cobalt type machining grade with cobalt in the 3% to 10% range.

7. The cutter of claim 1 wherein the cutting structure is disposed coaxial with the substrate.

8. The cutter of claim 1 wherein:

the flat face is circular, and the milling edge is disposed at a perimeter of the milling surface.

9. The cutter of claim 1 wherein the cutter is axisymmetric.

10. The cutter of claim 1 wherein the substrate comprises a rounded rear surface configured to be received by the cutter pocket.

11. The cutter of claim 1 wherein the substrate comprises a flat, circular surface configured to be received by the cutter pocket.

12. The cutter of claim 1 wherein the cutting structure is long substrate bonded to the substrate.

13. The bit of claim 1, wherein:

the milling edge and face are part of a cylindrical enlarged diameter portion of the substrate, and the diameter of the enlarged diameter portion is 10%-50% larger than a diameter of the cutting structure.

14. The bit of claim 1, wherein the cutting structure is brazed to the substrate.

15. An earth boring bit, comprising:

a plurality of blades, each blade having a plurality of cutter pockets; and the cutter of claim 1 secured within each cutter pocket.

16. The bit of claim 15 wherein each substrate defines an annular portion extending beyond the respective cutting structure, the annular portion secured within a recess of the respective cutter pocket.

17. The bit of claim 15 wherein each cutter is disposed at a rake angle of 5°-25° and a lesser rake angle corresponds to a greater clearance distance.

18. A method of drilling a wellbore, comprising:

deploying a mill-drill bit into a wellbore, the mill-drill bit comprising a plurality of blades and a plurality cutters disposed in pockets of the blades, each cutter comprising:

a cutting structure having a drilling edge and made from a superabrasive material; and a substrate secured to the cutting structure, made from a softer material than the superabrasive material, and having a milling edge, the softer material of the substrate configured to be received by a cutter pocket of the earth boring bit, the drilling edge of the cutting structure disposed radially internal to the milling edge of the substrate, wherein:

the substrate is delimited on an end adjacent to the milling edge by a flat face, the cutting structure is secured to the flat face, a portion of the flat face extending outward of the cutting structure is an exposed milling surface, and the milling edge, the flat face, and the milling surface are also made from the softer material;

milling through a casing or associated component thereof using the mill-drill bit, wherein:

the milling edges and surfaces engage with the casing or associated component thereof, and engagement of the milling edges with the casing or associated component thereof creates a clearance distance between the casing or associated component thereof and the cutting structure; and after milling, drilling through an earth formation with the mill-drill bit, wherein the milling edges are abraded by the formation, thereby resulting in contact of the drilling edges with the formation.

19. The method of claim 18, wherein the softer material is tungsten carbide and the superabrasive material is polycrystalline diamond compact or cubic boron nitride.

20. The method of claim 19, wherein the tungsten carbide is low cobalt type machining grade with cobalt in the 3% to 10% range.

21. The method of claim 18, wherein:

each milling edge and face are part of a cylindrical enlarged diameter portion of the respective substrate, and each diameter of the enlarged diameter portion is 10%-50% larger than a diameter of the respective cutting structure.

22. The method of claim 18, wherein each cutting structure is brazed to the respective substrate.

* * * * *